US007677335B2

(12) United States Patent
Cao et al.

(10) Patent No.: US 7,677,335 B2
(45) Date of Patent: Mar. 16, 2010

(54) TOOLS AND TECHNOLOGY OF RADICAL AND LEVEL DRILLING/WELL COMPLETION UNDER ULTRA-SHORT RADIUS

(75) Inventors: Xi Cao, Beijing (CN); Caocun Zhang, Beijing (CN); Caoxu Zhang, Beijing (CN)

(73) Assignee: Beijing Wanwei Yitong Technological Development Co. Ltd., Beijing (CN)

( * ) Notice: Subject to any disclaimer, the term of this patent is extended or adjusted under 35 U.S.C. 154(b) by 124 days.

(21) Appl. No.: 11/988,000

(22) Filed: Dec. 6, 2007

(65) Prior Publication Data

US 2009/0000824 A1 Jan. 1, 2009

(30) Foreign Application Priority Data

Jun. 28, 2007 (CN) ..... 2007 1 0011888

(51) Int. Cl.
*E21B 7/08* (2006.01)

(52) U.S. Cl. ..... 175/61; 175/73

(58) Field of Classification Search ..... 175/61, 175/73, 74

See application file for complete search history.

(56) References Cited

U.S. PATENT DOCUMENTS 2,565,794 A * 8/1951 Young ..... 175/61
2,667,332 A * 1/1954 McCune et al. ..... 175/83
2,778,603 A * 1/1957 McCune et al. ..... 175/314
2,863,638 A * 12/1958 Thornburg ..... 173/197
6,202,761 B1 * 3/2001 Forney ..... 175/61
7,287,604 B2 * 10/2007 Aronstam et al. ..... 175/61
7,370,710 B2 * 5/2008 Trueman et al. ..... 175/62
2006/0169495 A1 * 8/2006 Kolle ..... 175/61
2006/0254825 A1 * 11/2006 Krueger et al. ..... 175/61
2009/0101363 A1 * 4/2009 Teixeira ..... 166/384

* cited by examiner

*Primary Examiner*—Shane Bomar
(74) *Attorney, Agent, or Firm*—Smith, Gambrell & Russell, LLP

(57) ABSTRACT

A system of components and a method is provided for radial and level drilling and completion with an ultra-short radius which includes a deflecting drill tool assembly and a level drill tool assembly. The deflecting drill tool has a deflecting rotary assembly, flexible drill pipe, directional follow-up tube, tail tube for deflecting drill tool, and drill pipe nipple joints. The level tool has a level rotary assembly, the flexible drill pipe, quick couplings, the directional follow-up tube, a tail tube for level drill tool, the drill pipe nipple joint, an adjusting nipple joint, a recessed left hand thread bushing, and convex left hand thread coupling. A triangle backing block is installed on outside of a casing of the deflecting rotary assembly. Splines matched with each other are provided at the level rotary assembly and the flexible drill pipe. The tail tube for level drill tool has a recessed left hand thread bushing and convex left hand thread coupling. A body of an inner ball is situated in a ball bowl and in frontal part of the main body of the flexible drill pipe and any single section of the flexible drill pipe may bend 3°-6°.

16 Claims, 9 Drawing Sheets

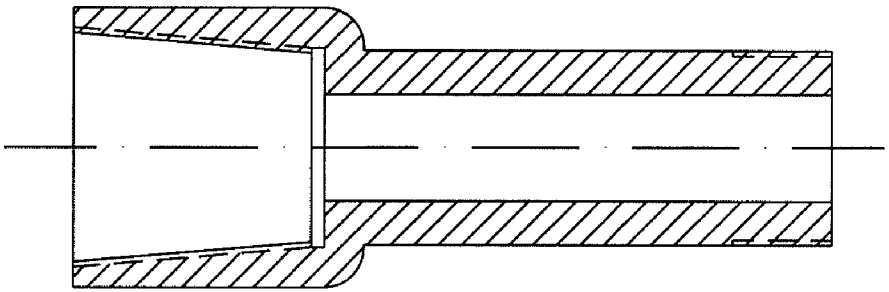
Fig.11
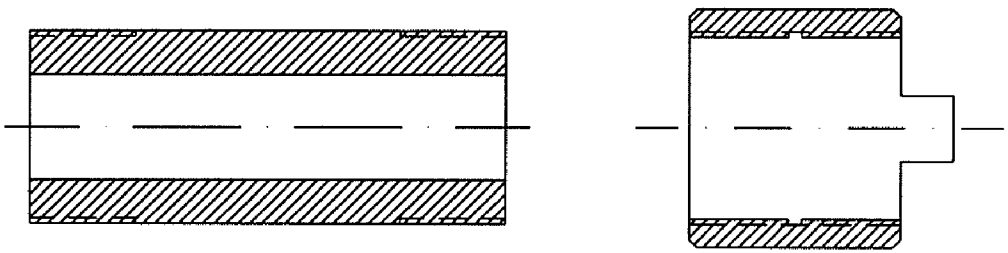
Fig.12
Fig.13

TOOLS AND TECHNOLOGY OF RADICAL AND LEVEL DRILLING/WELL COMPLETION UNDER ULTRA-SHORT RADIUS

FIELD OF THE INVENTION

The invention relates to a field of extracting petroleum, particularly to a special drilling tool and oil extraction technology; namely, an apparatus and method for radial and level drilling and completion with an ultra-short radius.

BACKGROUND OF THE INVENTION

Although R&D work on an ultra-short radius level drilling tools has gained a lot of results, there are still many technical problems. In drilling work for inclined interval and level interval, same kind of drilling tools are being used at present. During level interval drilling after finishing inclined interval, an orientation is difficult to be controlled, easy to cause deviation. The earlier developed drilling tools have the shortcoming that structuring members of flexible drill pipe are fixed up or connected together by way of clasping and welding, which leads to being difficult in assembling and time-consuming in service. Besides, drilling fluid is being delivered in a way of normal circulation in drilling process, which is easy to bring about "sand sticking" and to lower working efficiency.

SUMMARY OF THE INVENTION

For overcoming the technical problems mentioned above, the purpose of the invention is to introduce a new technology together with a new set of special drilling tools consisting respectively of deflecting and level drilling tools. This new technology and related new tools are featured with more accurate drilling, more convenient servicing and easier assembling. The structural members of the flexible drill pipes are fitted together with external and internal splines and matching nuts, resulting in more convenient assembling and service. What is more, drilling fluid is delivered in a way of reverse circulation in a drilling process, which avoids, effectively, "sand sticking" so as to improve working efficiency.

The ultra-short radius radial and level drilling and well completing tools are involved with a deflecting drill tool and a level drill tool. The deflecting drill tool is comprised of a deflecting rotary assembly, flexible drill pipe, directional follow-up tube, tail tube for deflecting drill tool, and drill pipe nipple joints; the level tool is comprised of a level rotary assembly, the flexible drill pipe, quick couplings, the directional follow-up tube, a tail tube for level drill tool, the drill pipe nipple joint, an adjusting nipple joint, a recessed left hand thread bushing, and convex left hand thread coupling and is characterized in that:

a) The deflecting rotary assembly has a deflecting drill bit installed on front end of its central shaft, on which, besides a centralizing bearing and a pressure bearing, there is provided a collar and a felt washer assemblage, with a triangle cross-sectioned backing block outside of a casing. A rear end of the deflecting rotary assembly is connected with the flexible drill pipe by means of nuts and by way of a main body of a flexible drill pipe. The level rotary assembly has a level drill bit installed on a front end of its horizontal shaft, the rear end of the level rotary assembly having an internal spline connected with the quick coupling, and a centralizing bearing and the pressure bearing, collar and felt washer assemblage are set inside of a casing, a rectangle cross-sectioned backing block is set outside of the casing.

b) The flexible drill pipe is made up of several single sections each of which is 140~150 mm long and is comprised of five parts; at front end of an inner ball there is a cylindrical shaped tail with the external spline; and there is the internal spline on the main body of the flexible drill pipe; the external spline and internal spline are matched through the nut tightening; a ball body of the inner ball, surrounded with steel balls, is located inside a ball bowl and at front part of the main body of the flexible drill pipe. Also, the ball bowl and the main body of the flexible drill pipe are threaded tight by a covering; and a last section of the flexible drill pipe is integrally united with the adjusting nipple joint through the nut tightening.

c) The quick couplings match mutually, and the quick coupling is united with a tail of the horizontal shaft integrally through the nut tightening. Also, the quick couplings have a central tube, an external spline and internal spline respectively and also a gasket and gland.

d) The directional follow-up tube is made of a slotted seamless steel pipe and, over the slotted pipe, there is installed bending angle banking stops, with 6-8 mm thick and 70-75 wide dimensions, and cover plates that are situated above bending angle banking stops for restricting lateral movement of bending angle banking stops. There is a space between slots is 100-110 mm, while the width of the slot is 3.5-4 mm and at a lower part of the pipe there is left a 50-70 mm width of pipe wall to serve as a rib.

e) There are two kinds of tail tubes, one is tail tube for the deflecting drill tool, another is a tail tube for the level drill tool, wherein a right hand thread bushing is connected to a straight tube by means of a right hand thread coupling and a recessed left hand thread bushing is connected to a straight tube by means of a left hand thread coupling.

Under an embodiment of the invention radial and level drilling and well completion under an ultra-short radius, includes the following:

a) Cut a window on a well pipe wall at a desired depth by using a whip-stock and milling cone firstly.

b) Inclined drilling: Fix the deflecting rotary assembly onto a front end of the directional follow-up tube connected to the tail tube for a deflecting drill tool. After putting the flexible drill pipe into the directional follow-up tube and connecting the flexible drill pipe with a central shaft of the deflecting rotary assembly, the assembled body is placed into a well. Under functioning of the whip-stock, a drill bit moves out of the well pipe wall, from the window slot, to keep performing inclined drilling until a desired footage is reached. The inclined drilling tool is then lifted up;

c) Level drilling: Fix the level rotary assembly onto the front end of the directional follow-up tube that is connected to the tail tube designed for the level drill tool. The flexible drill pipe, having the quick coupling at its front end, is placed into the directional follow-up tube. The adjusting nipple joint and the drill pipe are connected at a tail of the flexible drill pipe by using a patching of flexible drill pipe. After being matched with each other, the convex left hand thread coupling and the recessed left hand thread bushing are connected to the adjusting nipple joint by way of screwing. The assembled body is then positioned into the well after connection by using the recessed left hand thread bushing and the convex left hand thread coupling. The flexible drill pipe transmits torque to the level drill bit and drives it to perform level drilling, the directional follow-up tube follows up until a desired footage is reached. Upon ending of the drilling work, the quick couplings are removed by reversing the coupling for half a turn and then lifting the flexible drill pipe to such an extent that the convex left hand thread coupling is lifted to the recessed left hand bushing of the tail tube. Upon turning the drill pipe forward the recessed left hand thread bushing is separated from the left hand thread coupling. The flexible drill pipe is lifted out of the well and the directional follow-up tube and the level rotary assembly are left in a level interval and the tail tube for level drill tool operation in the straight hole;

d) Finishing well completion work after lead seal setting.

An included angle of 2°-3° is formed between the deflecting drill bit and the directional follow-up tube in the same bending direction due to the triangle backing block installed on outside of the casing of the deflecting rotary assembly. The central shaft is raised by means of the rectangle backing block installed on outside of the casing of the level rotary assembly, so that the level drill bit may work in level direction. The external spline and internal spline and nuts are used for connecting sections of the flexible drill pipe and any single section of the flexible drill pipe may bend 3°-6°; the flexible drill pipe may be rotated within the range of 360°, each meter of the flexible drill pipe to bend is 18~22°. Drilling fluid is conveyed in drilling process, through the annular space formed between the well pipe wall and the flexible drill pipe and then is returned to ground along a drill bit hole and a central hole of flexible drill pipe. For example, drilling fluid is conveyed in a way of reverse circulation. When a desired drilling depth is reached, the flexible drill pipe is separated from the level rotary assembly via the quick coupling. The flexible drill pipe is lifted to an extent in which the convex left hand coupling is up to the recessed left hand bushing of the tail tube. The flexible drill pipe is then turned forward so that the recessed left hand thread bushing is separated from the convex left hand thread coupling. The flexible drill pipe is then lifted out of well leaving behind the directional follow-up tube and the level rotary assembly in the level interval and tail tube for level drill tool in the straight hole. There is accomplished the work of well completion after lead seal setting.

Advantages of the invention are summarized as follows:

1. For conventional flexible drill pipes, their parts and components are fixed and connected with welding technology. In this invention a new technology for part and component fixing and connection is introduced for making flexible drill pipes—by means of splines and threading. This technology is not only time and labor saving but also easy and convenient in service.

2. Conventional directional follow-up tube is made up of trapezoidal shaped short pipe welded on a steel plate. New technology is adopted in the invention by making slotted seamless steel pipe and 50-70 mm width of tube wall left at lower part, serving as rib, which enhances intensity of parts and saves spaces.

3. For conventional technology, deflecting process is proceeded at target zone, 2-3 m of casing wall has to be cut off before utilizing whip-stock to exercise deflecting. Only a 1-1.3 m width of window in the present invention has to be cut on casing wall before deflecting operation so that reducing site work difficulty a lot and saving site work time for 2-3 days as well as less damage to casing wall and increasing its strength.

4. For conventional technology, drilling fluid is conveyed in a way of positive circulation. This invention adopts reverse circulation process for conveying drilling fluid, which has the advantages of a thorough removal of rock cuttings to ensure more accurate drilling. Since drilling fluid is delivered between the flexible drill pipe and well wall and returned to ground along holes of drill bit and the flexible drill pipe, the "sand sticking" phenomenon is avoided and work efficiency increased.

BRIEF DESCRIPTION OF THE DRAWINGS

FIG. 11 is a schematic drawing of the drill pipe nipple joint (6);

FIG. 12 is a schematic drawing of the adjusting nipple joint (7);

FIG. 13 is a drawing of the convex left hand thread coupling (8)'s structure;

Wherein, 1. deflecting rotary assembly; 2. level rotary assembly; 3. flexible drill pipe; 4. directional follow-up tube; 5. tail tube for deflecting drill tool; 5'. tail tube for level drill tool; 6. nipple joint of flexible drill pipe; 7. adjusting nipple joint; 8. convex left hand thread coupling; 8'. recessed left hand thread bushing; 9 & 9'. quick couplings; 11. deflecting drill bit; 12. central shaft; 13. collar; 14. centralizing bearing; 15. backing block; 16. pressure bearing; 17. felt washer; 18. casing; 21. level drill bit; 22. horizontal shaft; 23. centralizing bearing; 24. backing block; 25. casing; 31. inner ball; 31'. steel ball; 32. nut; 33. bowl; 34. covering; 35. bearing; 36. main body of the flexible drill pipe; 37. O-ring; 38. patching of flexible drill pipe; 39. external spline; 39'. internal spline; 41. coupling; 42. bending angle banking stop; 43. cover plate; 44. slotted steel pipe; 45. rib; 51. right hand thread bushing; 52. right hand threaded coupling; 53 & 53'. straight tube; 91. gasket; 92. gland; 93. central tube; A-A showing cut open view.

DETAILED DESCRIPTION OF THE INVENTION

The tool and the process and principle of extracting petroleum provided by the present invention are described in details associated with Figs below.

Example 1

Figure 1:
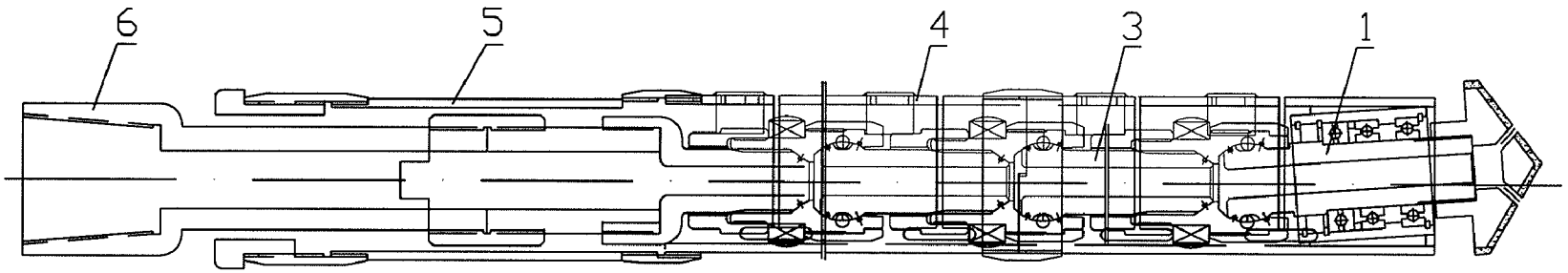
FIG. 1 is schematic drawing of the deflected drilling tool assembling.
Figure 2:
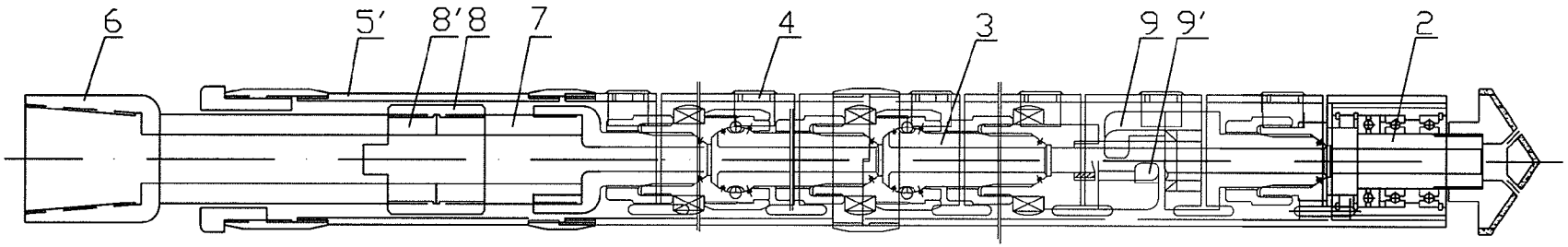
FIG. 2 is a schematic drawing of the horizontal drilling tool assembling.
Figure 3:
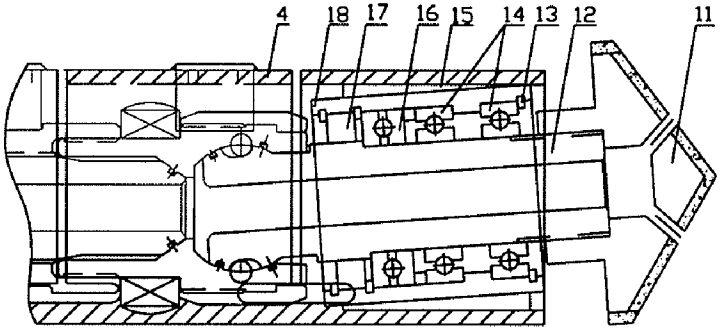
FIG. 3 is a schematic drawing of assembling structure of the deflecting rotary assembly (1) in FIG. 1.

1. Assembling of Various Tools of the Present Invention (1) Fixing of the deflecting rotary assembly 1, firstly. As shown in FIG. 3, fit, one after another, the centralizing bearing 14, the pressure bearing 16, the collar 13 (for sealing), and the felt washer 17 into the casing 18 and then put them onto the central shaft 12. Connect the deflecting drill bit 11 to the front end of the central shaft 12 by way of threading, weld triangle backing block 15 onto an outer surface of the casing 18, and then weld the resulting deflecting rotary assembly 1 onto front end of the directional follow-up tube 4.

Figure 4:
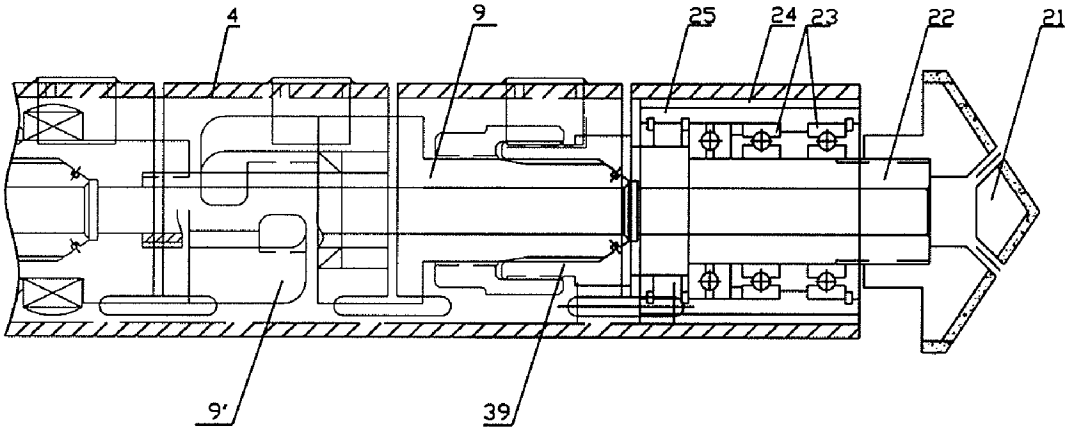
FIG. 4 is a schematic drawing of assembling structure of the level rotary assembly (2) in FIG. 2.

(2) Fixing of the level rotary assembly 2. As shown in FIG. 4, fit, one after another, the centralizing bearing 23, the pressure bearing 16, collar 13, and the felt washer 17 into the casing 25 and then put them onto the central shaft 22. Connect the level drill bit 21 to front end of the horizontal shaft 22 by way of threading, weld rectangle cross-sectioned backing block 24 onto an outer surface of the casing 25. Join together the opposite internal spline 39' of the quick coupling and external spline 39 of the central shaft, and then fixedly join the internal spline 39' and external spline 39 by way of threading. Weld the resulting level rotary assembly 2 onto front end of the directional follow-up tube 4.

Figure 5:
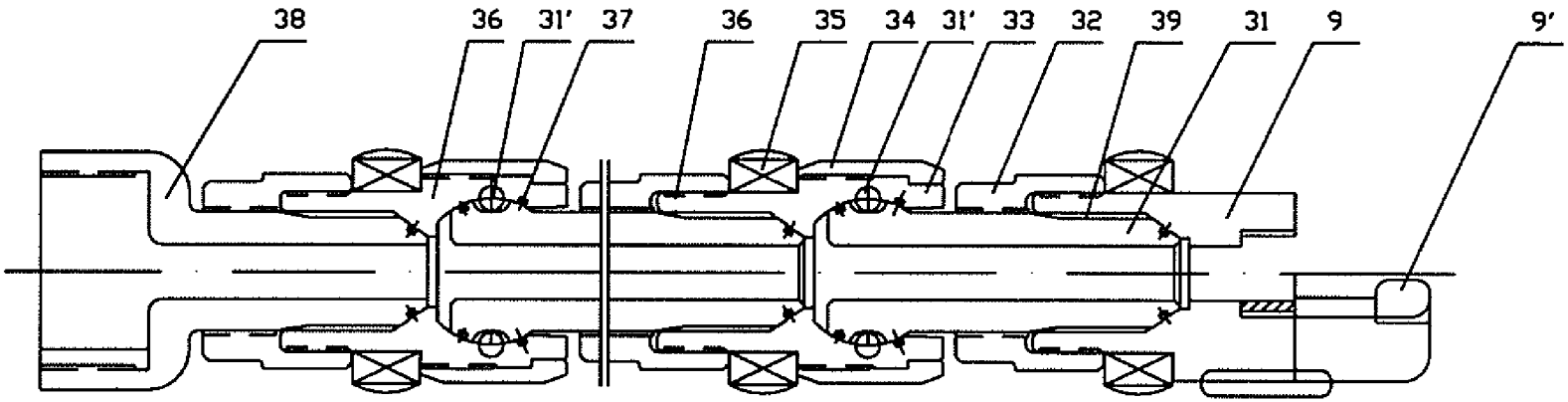
FIG. 5 is a schematic drawing of assembling structure of the flexible drill pipe (3)
Figure 14:
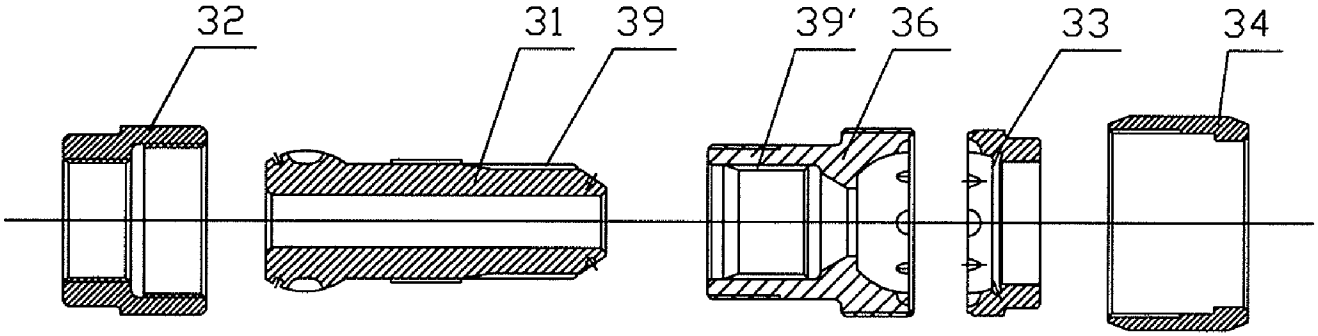
FIG. 14 is a break-down drawing of a single section of the nipple joint of flexible drill pipe (3)
Figure 15:
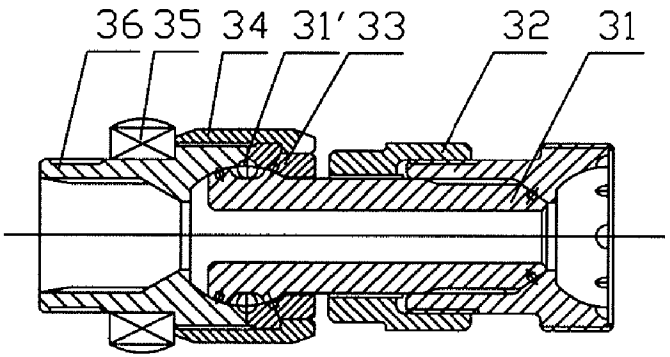
FIG. 15 is an assembly drawing of a single section of the nipple joint of flexible drill pipe (3)
Figure 17:
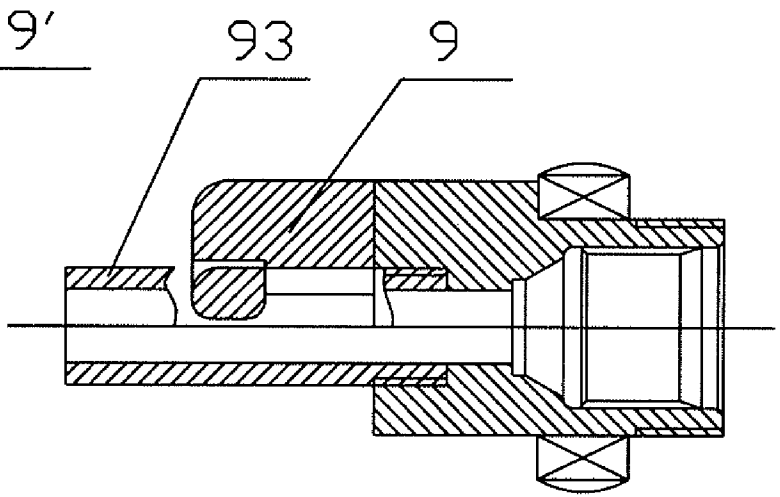
FIG. 17 is a schematic drawing of the quick coupling (9)'s structure.
Figure 16:
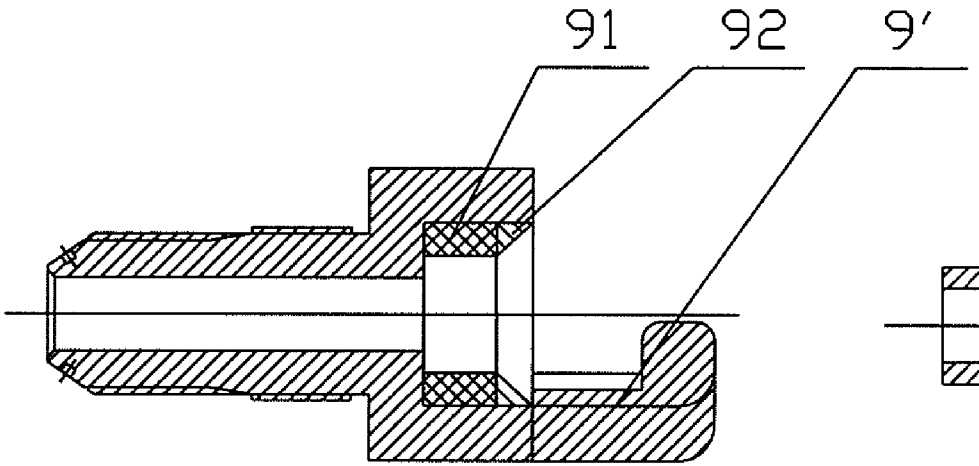
FIG. 16 is a schematic drawing of the quick coupling (9')'s structure.

(3) Fixing of the flexible drill pipe 3. As shown in FIG. 5, the flexible drill pipe 3 is composed of several single sections connected with each other, and each single section is 140 mm long, in this example, providing a total length of the flexible drill pipe of 14.0 m in the illustrated embodiment. A single section of the flexible drill pipe shown is comprised of the inner ball 31, the nut 32, the bowl 33; the covering 34 and the main body of the flexible drill pipe 36 (five parts). As shown in FIGS. 14 and 15, the external spline 39 is installed on cylindrical shaped tail of the inner ball 31 at its front end and the internal spline 39' is installed on the main body of the flexible drill pipe 36. The matched external spline 39' and ]internal spline 39 are combined tight with the nut 32. A body of the inner ball 31 is situated in the ball bowl 33 and in a frontal part of the main body of the flexible drill pipe 36. As shown, steel balls 31' are surrounded, and the ball bowl 33 and the main body of the flexible drill pipe 36 are fixed by the covering 34. The last section of the flexible drill pipe 3 and the adjusting nipple joint 7 are integrally connected by the nut 32. A sealing O-ring 37 is placed in between. Bearings 35, located between the main body of the flexible drill pipe 36 and the directional follow-up tube 4, function to reduce friction between the flexible drill pipe and the directional follow-up tube. Sections are connected by means of the external spline 39 and the internal spline 39' and the nut 32. Splines function to transmit torque and the nut 32 is used to fix them tight. A single section of the flexible drill pipe may bend 3°-6°, based on the position of neighboring one, so that the flexible drill pipe may rotate and transmit torque within 360° to drive the level drill bit 21 to work via connection of the quick coupling 9' at front end of the flexible drill pipe 3 and quick coupling 9 at rear end of the level rotary assembly. The inner balls are to be made of 40#Cr—Mn—Mo and the steel balls 31' are of bearing steel.

Figure 6:
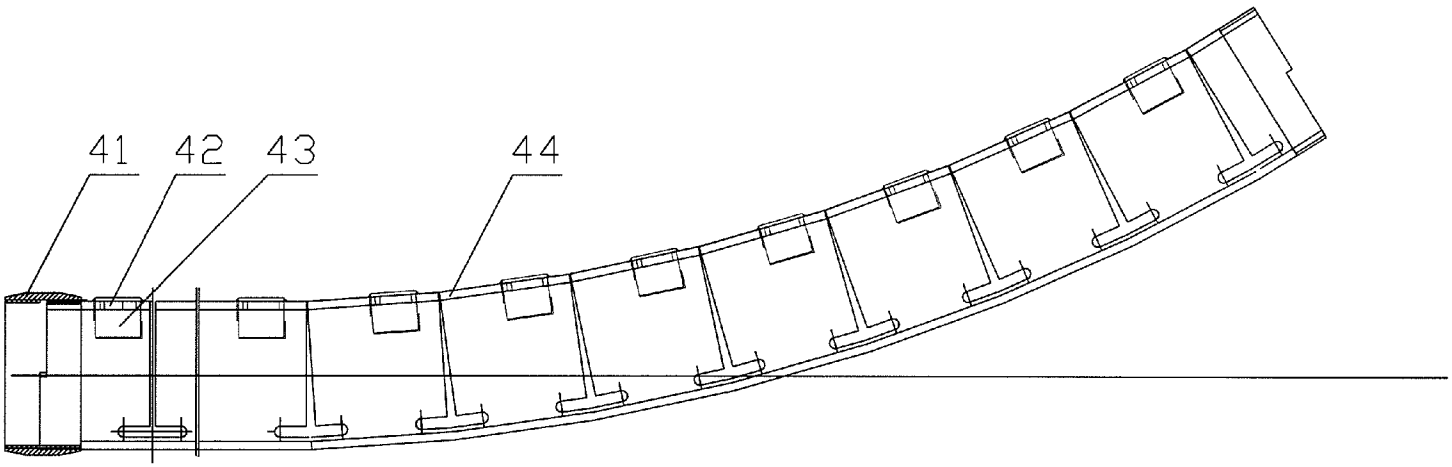
FIG. 6 is a schematic drawing of assembling structure of the directional follow-up tube (4)
Figure 7:
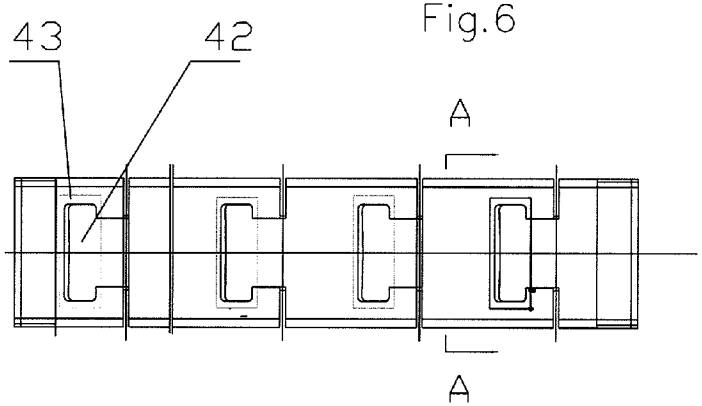
FIG. 7 is a top view of the FIG. 6.
Figure 8:
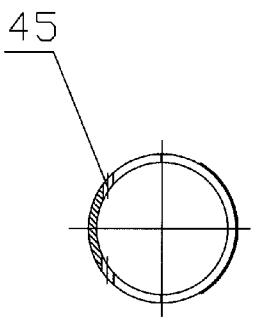
FIG. 8 is a cut-open view in direction A of the FIG. 7.

(4) Fixing of the directional follow-up tube 4. As shown in FIG. 6, the directional follow-up tube is made of a slotted seamless tube. On top of the slotted seamless tube 44 there is welded bending angle banking stop 42 made of 25#steel, 6 mm thick and 25 mm wide, over which is the cover plate 43 functioning to limit its lateral movement. At the lower part of the steel pipe there is left a wall width of 50~70 mm to serve as rib 45. The bending angle banking stop restricts the openness of steel pipe slots. The directional follow-up tube adopts a 108 mm diameter seamless steel tube having 3.5 mm wide slots with a spacing of 100 mm between slots. Width of slot, spacing distance between slots and rib width at lower part of steel pipe are all fixed values, and there are the bending angle banking stops for slots to restrict orientation and bending angle of directional follow-up tube according to the designed requirement.

Figure 9:
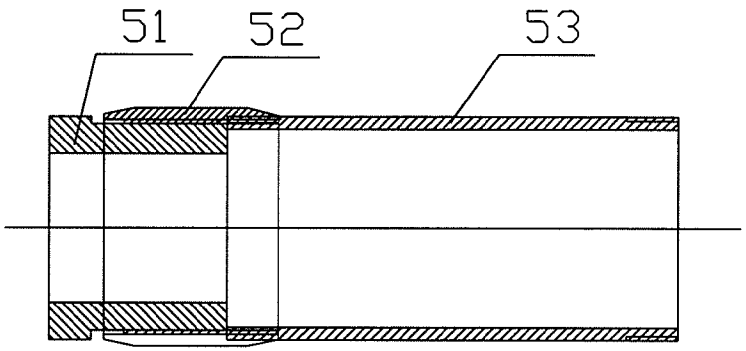
FIG. 9 is a schematic drawing of a structure of the tail tube (5) for deflecting drill tool.
Figure 10:
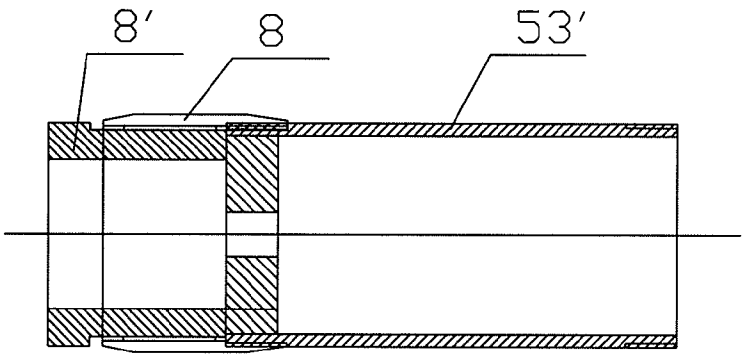
FIG. 10 is a schematic drawing of a structure of the tail tube (5') for the level drill tool.

(5) Fixing of tail tube. As shown in FIGS. 9 and 10, there are two types of tail tubes, one is tail tube 5 for the deflecting drill tool, another, tail tube 5' for the level drill tool. One end of the tail tube 5 for the deflecting drill tool is thread connected tight to the straight pipe 53 by means of the right hand thread bushing 51 and the right hand thread coupling 52, another end of it is further connected to the tail of the directional follow-up tube through the coupling 41. One end of the drill tool 5' for the level drill tool is tightly connected to the straight pipe 53' via the recessed left hand thread bushing 8' and the convex left hand thread coupling 8 in a way of left hand threading. Another end of it is connected to the directional follow-up tube 4 via the coupling 41 by way of left hand threading.

2. Depending on the particular process and their working principles, these drilling tools are operated in ways such as the following:

Step 1, a window of 1.0 m length is cut on the wall of well pipe at the desired depth with the aid of a hanging whip-stock and milling cone.

Step 2, inclined Drilling. Sink the directional follow-up tube 4, which is weld connected with the deflecting rotary assembly 1 at its front end and connected with the tail tube 5 for the deflecting drill tool at its rear end via the coupling 41, into the well and hang it at the well mouth by means of a lift sub. Fit the flexible drill pipe 3 into the directional follow-up tube 4 and then connect it with the central shaft 12 of deflecting rotary assembly through the nut 32. Tail of the patching of flexible drill pipe 38 is thread connected to the nipple joint of flexible drill pipe 6 having the right hand thread coupling 51. Connect the right hand thread bushing 51 to the right hand thread coupling 52 at end of tail tube 5 for deflecting drill tool, and install a centralizer and conventional drill pipe to the nipple joint of the flexible drill pipe 6. The integrated assemblage is then inserted into the well. Under the function of the whip-stock, the deflecting rotary assembly 1 and deflecting drill bit 11 go through the cut window on well pipe wall and move out of it to perform inclined drilling to the level direction, until designed footage is reached. Each group of inner balls may bend 3°-6°, based on the position of neighboring one, and each meter of the flexible drill pipe may bend 20°, based on the position of neighboring one. Deflecting angle is 90°; inclined drilling speed=90°/20°=4.5 m, namely, when drilling at 4.5 m, curvature radius R=Circumference/(2p)=inclined drilling speed*4/(2p)=4.5*4/(2p)=2.87 m. After finishing inclined drilling, the deflecting drill tool is lifted out of the well.

Step 3, Level Drilling. Sink the directional follow-up tube 4, which is weld connected with the level rotary assembly 2 at its front end and connected with the tail tube 5' for the level drill tool at its rear end via the coupling 41, into well and hang the assembled body at the well mouth by means of the lift sub. Fit the flexible drill pipe 3, having the quick coupling 9' at its front end, into the directional follow-up tube 4, and then threadably connect the tail of the patching of flexible drill pipe 38, the adjusting nipple joint 7 and the convex left hand thread coupling 8. The nipple joint of the flexible drill pipe 6 is sleeved with the recessed left hand thread bushing 8' which is threaded on to the convex left hand thread coupling 8 resulting in the recessed left hand thread bushing 8' being connected with the convex left hand thread coupling 8 at the end of the tail tube 5' for the level drill tool. Since the outside dimension of the convex coupling is greater than the inner diameter of the recessed left hand thread bushing 8', there is a lifting up of the drilling tool to cause the directional follow-up tube, having the tail tube 5' for the deflecting drill tool, to move upward and, after removing the lift sub, sink them altogether into the well. At the depth of deflecting drilling through the centralizer by means of a conventional drill pipe, proceed to perform level drilling through the torque transmitted, by the flexible drill pipe 3, to the level drill bit 21, with the directional follow-up tube to follow-up 4at the same time. When a designated footage such as 14 m is reached, drilling is stopped and then reversed for half a turn so that the quick couplings 9 and 9' separate from each other. Lift the drill pipe up to combine the convex and recessed faces of the convex left hand thread coupling 8 and the recessed left hand thread bushing 8' of tail tube. Turn forward the drill pipe so that the recessed left hand thread bushing and the convex left hand thread coupling separate from each other. Lift the drill pipe out of well and leave the directional follow-up tube 4 and the level rotary assembly 2 in the level well hole and tail tube 5' for level drill tool in the straight interval. In a drilling process, drilling fluid is conveyed in by way of a reverse circulation through the annular space between the well casing and the drill pipe and returned to ground through central holes of the drill bit and the drill pipe. This ensures a thorough removal, of rock cuttings and avoiding "sand sticking".

Step 4, Finish well completion work after lead seal setting.

Example 2

Assembling of Various Parts of the Present Invention (1) Level drilling footage is 45.0 m; length of the fixed flexible drill pipe is 45.0 m, each section of the flexible drill pipe being 150 mm long. Inner balls are made of 40# Cr—Ni—Mo.

(2) The directional follow-up tube 4 is made of slotted seamless steel tube, width of slot being 4 mm and spacing between slots being 110 mm. There are 70 mm width of tube wall to be left at lower part of the tube, serving as rib.

Drilling process:

At the designed drilling depth, a 1.3 m window has to be cut on the casing wall. Bending degree of the flexible drill pipe is 18°/m and the deflecting angle is 90°. For every 5.0 m of drilling footage, the curvature radius R=5.0*4/(2p)=3.18 m, which is within the range of ultra-short radius deflecting process all the same.

The process for making other parts and technology of drilling are described the Example 1.

Example 3

Assembling of Various Parts of the Present Invention (1) Level drilling footage is 98.0 m; each section of the flexible drill pipe being 140 mm long, Length of the fixed flexible drill pipe installed is 98.0 m, Inner balls are made of 42# Cr—Mo.

(2) The width of slot of the directional follow-up tube 4 is 4 mm and spacing between slots being 105 mm. There are 60 mm width of tube wall to be left at lower part of the tube, serving as a rib.

Drilling process:

Bending degree of the flexible drill pipe is 22°/m and the deflecting angle is 90°. For every 4.1 m of drilling footage, the curvature radius R=4.1*4/(2p)=2.61 m.

The process for making other parts and technology of drilling are described in the Example 1.

We claim:

1. A system for radial and level drilling and completion with an ultra-short radius, comprising:

a deflecting drill tool assembly comprised of;

a first type tail tube;

a directional follow-up tube having a first end connected with said first type tail tube and a second end;

a deflecting rotary assembly connected to the second end of said directional follow-up tube; said deflecting rotary assembly having a casing receiving a shaft that is rotationally supported in said casing and a drill head supported on said shaft, and said shaft being supported in a deflected fashion as to have a central axis at an angle deflected from the central axis of said casing for deflected angle drilling;

a flexible drill pipe that is received in said follow-up tube and is in driving engagement with said shaft;

an upstream nipple joint in driving engagement with said flexible drill pipe;

a level drilling assembly comprised of, a second type tail tube;

said directional follow-up tube, with the first end of said directional follow-up tube connected with the second type tail tube when operating in a level drilling assembly mode, a combination left hand thread coupling assembly and adjusting nipple joint device which combination is placed in a driving connection line between said upstream nipple joint and said flexible drill pipe when operating in a level drill assembly mode, a level rotary assembly having a level drilling casing which receives a rotary supported level drilling shaft and a level drilling drill head with a central axis of elongation of the level drilling shaft being generally aligned with the central axis of elongation of the level drilling casing, and a quick coupling that is positioned, relative to a driving connection line, between said flexible drill pipe when operating in the level drilling assembly mode and said level drilling shaft.

2. The system of claim 1 wherein said level drilling shaft is one in the same as said shaft of the deflecting drill assembly.

3. The system of claim 2 further comprising a common shaft enclosure casing utilized for each of the deflected drilling mode and level drilling mode and within said common shaft enclosure casing there is provided a combination of a pressure bearing and a centralizing bearing assembly positioned as to be in contact with said common shaft.

4. The system of claim 3 further comprising a wedge shape cross-sectioned backing block forming a component of said deflecting drill tool assembly and a rectangular cross-sectioned backing plate forming part of said deflection drill tool assembly, with each of said backing blocks being external to said common casing to provide a desired shaft orientation.

5. The system of claim 1 wherein a rear end of said deflecting rotary assembly is connected with said flexible drill pipe by way of a nut connection with a main body portion of said flexible drill pipe.

6. The system of claim 1 wherein a rear end of said level rotary assembly has a splined section that is in contact with said flexible drill pipe.

7. The system of claim 1 wherein the flexible drill pipe is comprised of a plurality of sections with each section including, in a rearward to forward assembled direction, a main body having an open forward end, a covering, and a bowl fixed relative to said main body by way of said covering, an inner ball component having a ball end received by both said bowl and the open rear end of said main body, a ball bearing set which is positioned within ball bearing cavities formed between an interior inner ball cavity and an exterior bearing cavity provided in a region of said bowl and main body, said inner ball also including a tail section with splines that are arranged to receive a splined portion of a main body of another flexible drill pipe section in line, and a nut designed to connect said tail section with the main body of another section in line.

8. The system of claim 7 wherein a rear positioned flexible drill pipe section is connected to the adjusting nipple joint in the level drilling assembly by way of said nut provided in each section of said flexible drill pipe.

9. The system of claim 7 wherein any section of the sections of said flexible drill pipe may bend 3 to 6° with the flexible drill pipe.

10. The system of claim 9 wherein each section is dimensioned such that each meter of the flexible drill pipe can form a bend of 18-22°.

11. A method of radial and level drilling and completion with an ultra-short radius, comprising:

cutting a window in a well pipe wall;

performing an inclined drilling step by fixing a deflecting rotary assembly onto the front end of a directional follow-up tube and inserting a flexible drill pipe within the directional follow-up tube, said deflecting rotary assembly having a drill bit that is driven to perform a desired amount of inclined drilling radially external to said well pipe wall window, and then lifting up to ground the deflecting rotary assembly;

performing level drilling by fixing a level drilling rotary assembly with level drilling bit onto the front end of the directional follow up tube which receives the flexible drill pipe together with a quick coupling in line with said flexible drill pipe, and driving said level drilling bit to a desired depth.

12. The method of claim 11 wherein, following a decoupling of said quick coupling and a lifting of the decoupled flexible drill pipe out of the well, there is left behind the directional-follow up tube and the level rotary assembly in the level hole that is drilled.

13. The method of claim 12 wherein further placed in line with said flexible drill pipe is a left hand thread coupling, and said method includes decoupling of the quick coupling and lifting of the flexible drill pipe to such an extent to place components of said left hand thread coupling into a decoupling ready state which, following rotation of said flexible drill pipe detaches the left hand thread coupling components and then further lifting of said flexible drill pipe out of the well.

14. The method of claim 11 further comprising conveying drilling fluid during a drilling process through an annular space formed between a well pipe wall and the flexible drill pipe and returning the fluid to ground along a drill bit hole and a central hole of said flexible drill pipe.

15. The method of claim 14 wherein fluid conveyance includes reverse circulation fluid conveyance.

16. The method of claim 11 wherein there is attached to said flexible pipe a first tail tube type during the inclined drilling step and a second type of tail tube type during the level drilling step and said second type tail tube being configured as to include a left hand threaded bushing that is separated, and lifting the flexible drill pipe out from the well as to leave behind the directional-follow up tube and the level rotary assembly in the level hole that is drilled.

* * * * *